US006371062B1

(12) United States Patent
Rao et al.

(10) Patent No.: US 6,371,062 B1
(45) Date of Patent: Apr. 16, 2002

(54) VARIABLE COMPRESSION RATIO CONNECTING RODS

(75) Inventors: V. Durga Nageswar Rao, Bloomfield Township; Daniel Joseph German; Gary Allan Vrsek, both of Brighton; Jeffrey Eliot Chottiner, Farmington Hills; Mark Michael Madin, Canton, all of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/691,668

(22) Filed: Oct. 18, 2000

(51) Int. Cl.[7] ..... F02B 75/04
(52) U.S. Cl. ..... 123/48 B; 123/78 E
(58) Field of Search ..... 123/48 B, 78 E

(56) References Cited

U.S. PATENT DOCUMENTS

| | | | | |
|---|---|---|---|---|
| 1,835,096 A | * 12/1931 | Schwarz | 123/78 E |
| 1,875,180 A | 8/1932 | Rider | 123/78 E |
| 2,376,214 A | 5/1945 | Webster | 123/78 R |
| 3,633,429 A | 1/1972 | Olson | 74/44 |
| 4,300,405 A | 11/1981 | Szczepanek | 74/44 |
| 4,510,895 A | 4/1985 | Slee | 123/48 B |
| 4,517,931 A | 5/1985 | Nelson | 123/48 B |
| 4,687,348 A | 8/1987 | Naruoka et al. | 384/255 |
| 4,979,427 A | 12/1990 | Pfeffer et al. | 92/60.5 |
| 5,562,068 A | 10/1996 | Sugimoto et al. | 123/48 B |
| 5,755,192 A | 5/1998 | Brevick | 123/78 B |

FOREIGN PATENT DOCUMENTS

DE 19844200 * 6/1999

* cited by examiner

*Primary Examiner*—Noah P. Kamen
(74) *Attorney, Agent, or Firm*—Jerome R. Drouillard

(57) ABSTRACT

A variable length connecting rod assembly for imparting a variable compression ratio to an internal combustion engine. The assembly contains a first part (22; 72), a second part (20; 74), and a third part (34; 70) assembled together to form the large end of the connecting rod assembly and provide a variable length for the connecting rod assembly. The first part is a semi-circular cap. One (20; 74) of the second and third parts is fastened tight to the first part (22; 72). Guides (36, 38, 48; 88, 90, 92) disposed at opposite sides of the large end operatively relate the other (34; 70) of the second and third parts and the fastened parts to provide for relative sliding motion between the other of the second and third parts and the fastened parts over a limited adjustment range to change the length of the connecting rod assembly.

6 Claims, 2 Drawing Sheets

VARIABLE COMPRESSION RATIO CONNECTING RODS

BACKGROUND OF THE INVENTION

1. Field of the Invention

This invention relates generally to reciprocating piston type internal combustion (I.C.) engines for motor vehicles. More specifically it relates to I.C. engines having variable compression ratio connecting rods.

2. Background Information

A gasoline engine whose compression ratio remains invariant as operating conditions change is said to be knock-limited. This means that the compression ratio built into the engine design must be selected to avoid objectionable engine knock that would otherwise occur during certain conditions of engine operation if the compression ratio were larger. However, those conditions that give rise to engine knocking in a motor vehicle typically prevail for only limited times as the vehicle is being driven. At other times, the engine could operate with better efficiency, and still without knocking, if the compression ratio could be made higher, but unfortunately the engine is incapable of achieving more efficient operation during those times because its compression ratio cannot change.

Certain technologies relating to reciprocating piston I.C. engines having variable compression ratio pistons and connecting rods are disclosed in various patents, including U.S. Pat. Nos. 1,875,180; 2,376,214; 4,510,895; 4,687,348; 4,979,427; 5,562,068; and 5,755,192. Various reasons for employing such technologies in I.C. engines have been advanced in those documents. One reason is to improve efficiency by enabling an engine that is relatively more lightly loaded to run at a compression ratio that is higher than a compression ratio at which the engine operates when running relatively more heavily loaded.

The compression ratio of an engine can be varied by varying the overall effective length of a connecting rod and piston. Change in overall effective length may be accomplished in either the connecting rod, or the piston, or in both. The foregoing patents describe various mechanisms for varying overall effective length.

U.S. Pat. No. 5,562,068 discloses a variable compression ratio connecting rod where adjustment of effective length takes place at the large end. Adjustment is performed via an eccentric ring that is generally coincident with a crank pin, but can be selectively locked to the crank pin and to the large end of the rod. When locked to the crank pin, the eccentric ring assumes a position that causes the rod to have a longer effective length and hence a higher compression ratio. When locked to the rod, the eccentric ring assumes a position that causes the rod to have a shorter effective length and hence a lower compression ratio.

SUMMARY OF THE INVENTION

The present invention relates to further improvements in variable length connecting rods of reciprocating piston I.C. engines for varying engine compression ratios as engine operating conditions change. In particular the invention contemplates constructions for effecting length change at the large end of a connecting rod so that the incorporation of variable compression ratio by length change does not adversely contribute to the reciprocating mass of an engine in a way that might otherwise create unacceptable imbalance.

A general aspect of the invention relates to a variable length connecting rod assembly for imparting a variable compression ratio to an internal combustion engine. The assembly contains a first part, a second part, and a third part assembled together to form the large end of the connecting rod assembly and provide a variable length for the connecting rod assembly. The first part is a semi-circular cap. One of the second and third parts is fastened tight to the first part. Guides disposed at opposite sides of the large end operatively relate the other of the second and third parts and the fastened parts to provide for relative sliding motion between the other of the second and third parts and the fastened parts over a limited adjustment range to change the length of the connecting rod assembly.

Further aspects will be seen in various features of two presently preferred embodiments of the invention that will be described in detail.

BRIEF DESCRIPTION OF THE DRAWINGS

The drawings that will now be briefly described are incorporated herein to illustrate a preferred embodiment of the invention and a best mode presently contemplated for carrying out the invention.

DESCRIPTION OF THE PREFERRED EMBODIMENT(S)

Figure 1:
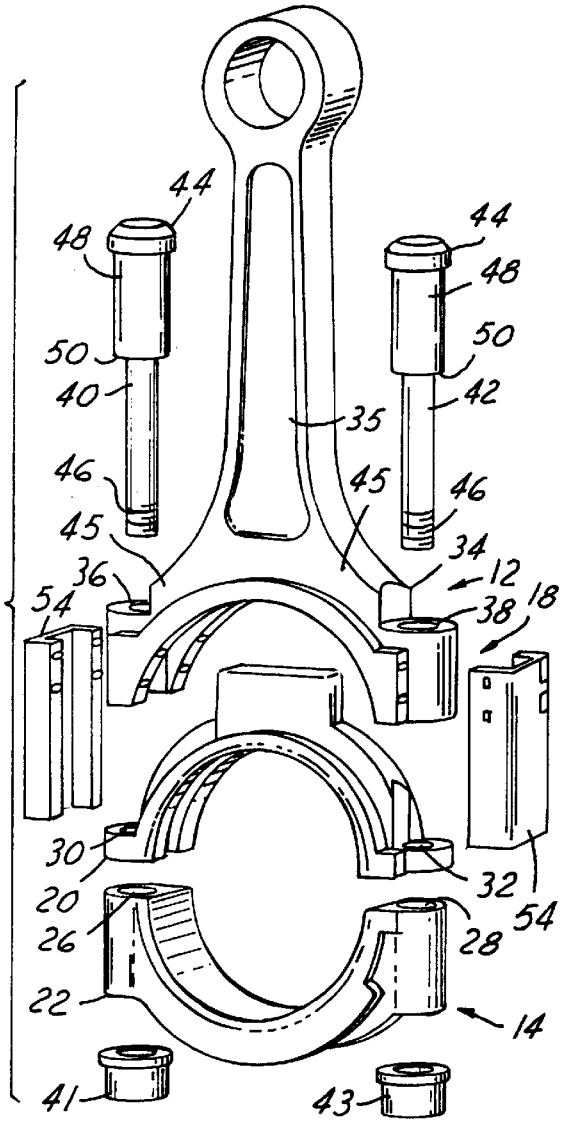
FIG. 1 is an exploded perspective view of a connecting rod constituting a first embodiment.
Figure 2:
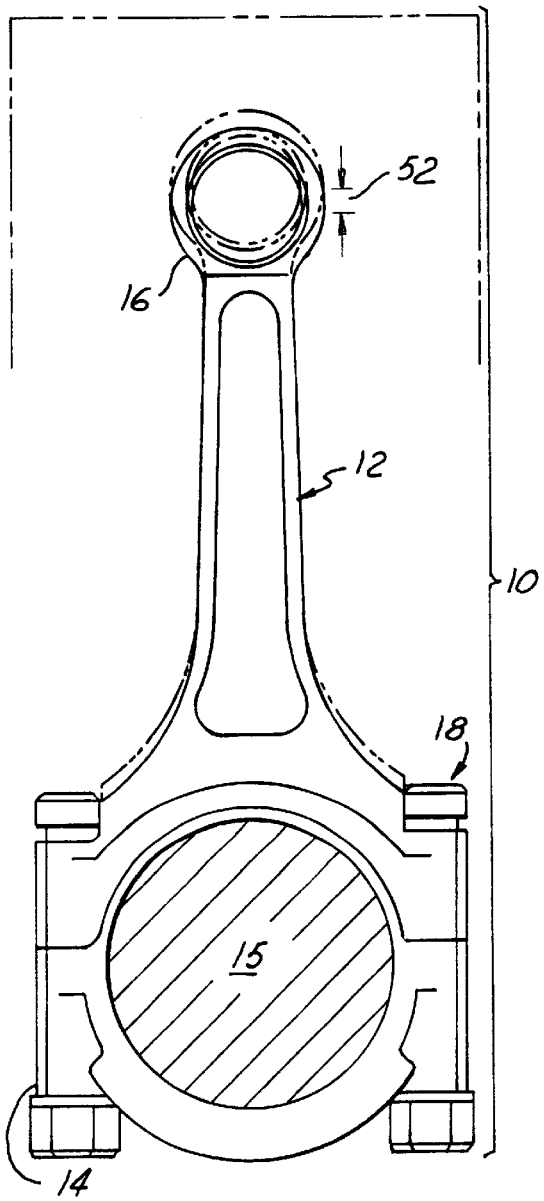
FIG. 2 is a non-exploded view of FIG. 1, looking along a main axis of an engine.

FIGS. 1 and 2 show a connecting rod 12 of a first piston/connecting rod embodiment 10 for endowing an engine with a variable compression ratio. Connecting rod 12 comprises a large end 14 for journaling on a crank pin 15 of a crankshaft and a small end 16 for journaling on a central portion of a wrist pin for coupling the connecting rod to the piston (as schematically shown). A variable length mechanism 18 is embodied in the connecting rod at its large end to provide for variation in overall length as measured between the large and small ends.

Large end 14 comprises an upper cap 20 and a lower cap 22 that are fastened together around the crank pin. Lower cap 22 comprises parallel through-holes 26, 28 at opposite ends of its semi-circumference. At opposite ends of its semi-circumference, upper cap 20 comprises through-holes 30, 32 that align with holes 26, 28 respectively when the two caps are girdling the crank pin.

Connecting rod 12 further comprises a part 34 containing a connecting rod portion 35. One end of part 34 contains small end 16, and the opposite end is coupled through variable length mechanism 18 with large end 14. That coupling comprises through-holes 36, 38 that align with through-holes 30, 32 respectively, fasteners 40, 42, and nuts 41, 43. Through-holes 36, 38 are disposed mutually parallel, and are contained in free ends of curved arms 45 that extend from connecting rod portion 35.

Each fastener 40, 42 comprises a head 44 at a proximal end and a screw thread 46 at a distal end. Intermediate proximal and distal ends, each fastener comprises a circular cylindrical guide surface 48. The parts are assembled in the manner suggested by the Figures with the respective fastener shanks passing though respective aligned through-holes 36, 30; 38, 32; and 26, 28; and threading into respective nuts 41,

43. The diameters of through-holes 36, 38 are larger than those of through-holes 30, 32 to allow shoulders 50 at the ends of guides 48 to bear against the margins of through-holes 30, 32. As the fasteners and nuts are tightened, such as by turning with a suitable tightening tool, the two caps 20, 22 are thereby forced together at their ends, crushing the crank pin bearing in the process.

The axial length of each guide surface 48, as measured between head 44 and shoulder 50, is slightly greater than the axial length of each through-hole 36, 38, and the diameters of the latter are slightly larger than those of the former to provide sliding clearance. In this way it becomes possible for rod part 34 to slide axially over a short range of motion relative to large end 12. That range of motion is indicated by the reference 52 in FIG. 2 and constitutes a limited adjustment range for changing the length of the connecting rod assembly. When arms 45 abut part 20 around the margins of through-holes 30, 32, the connecting rod assembly has minimum length. When arms 45 abut heads 44, the connecting rod assembly has maximum length.

Channels 54 may be assembled at the sides to provide additional bearing support for the axial sliding motion. Mechanism 18 may comprise passive and/or active elements for accomplishing overall length change, and resulting compression ratio change.

Figure 4:
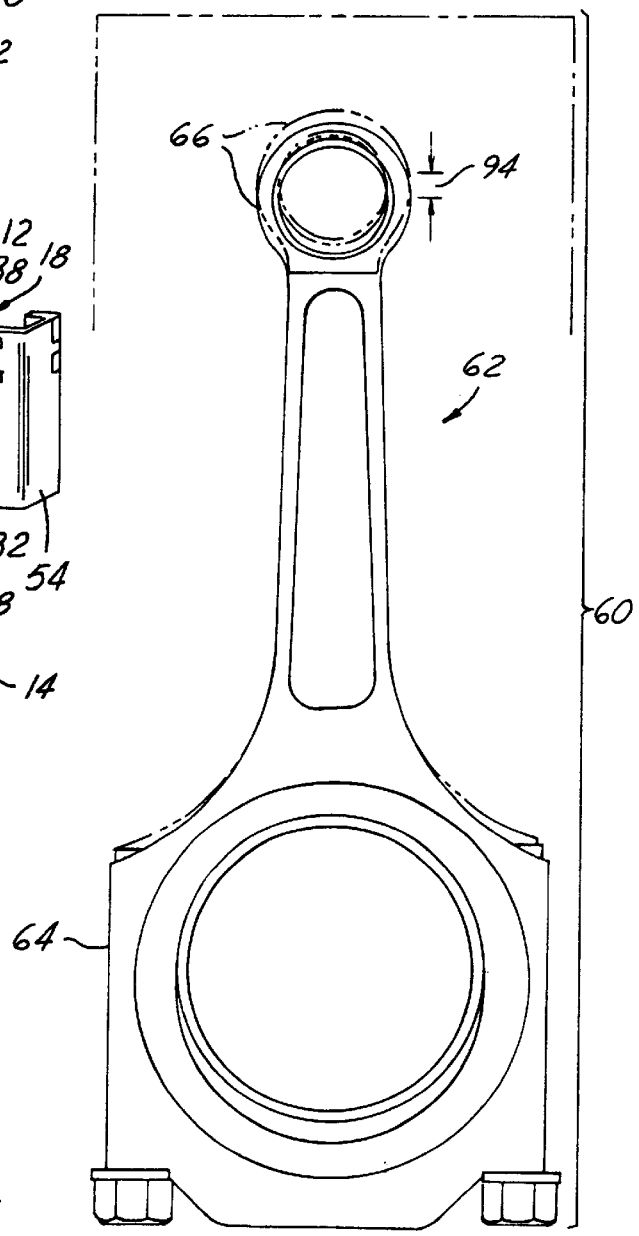
FIG. 4 is a non-exploded view of FIG. 3 looking along a main axis of an engine.
Figure 3:
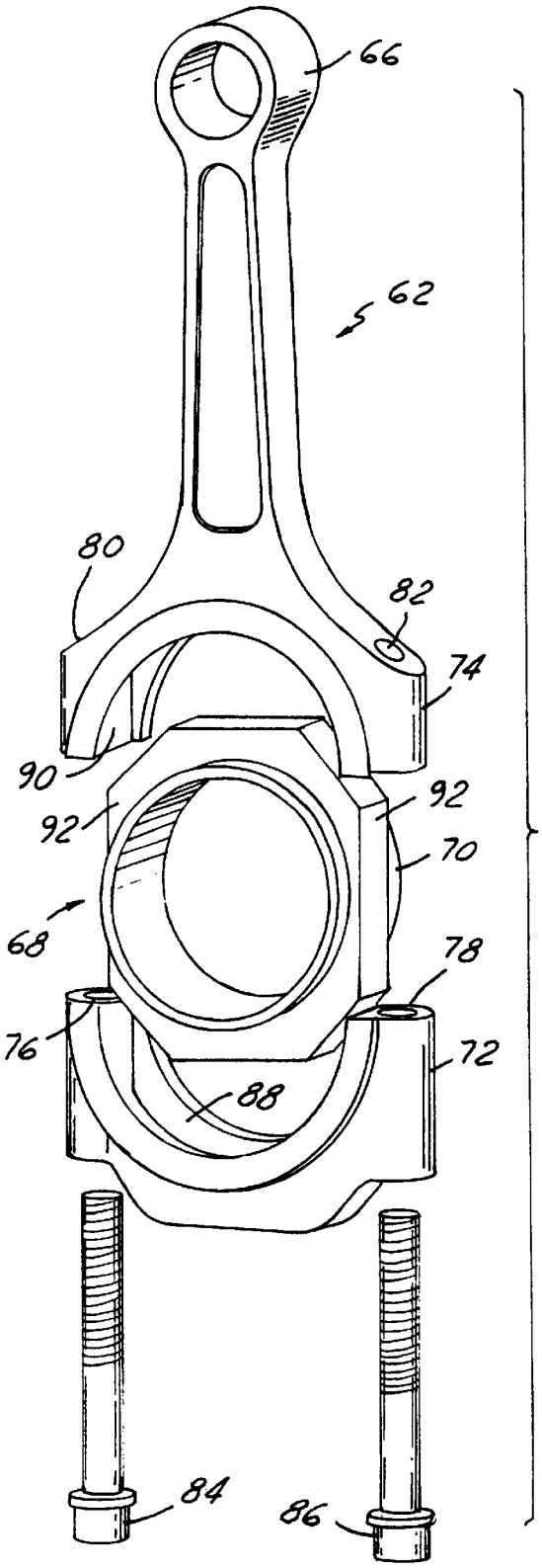
FIG. 3 is an exploded perspective view of a connecting rod constituting a second embodiment.

FIGS. 3 and 4 illustrate the connecting rod 62 of a second piston/connecting rod embodiment 60 for endowing an engine with a variable compression ratio. Connecting rod 62 comprises a large end 64 for journaling on a crank pin of a crankshaft (not shown) and a small end 66 for journaling on a central portion of a wrist pin (also not shown) for coupling the connecting rod to the piston (also not shown). A variable length mechanism 68 is embodied in the connecting rod at its large end to provide for variation in overall length between the large and small ends.

Mechanism 68 is provided by a bearing retainer 70 which is captured between a cap 72 and one end of a rod part 74. Opposite ends of the semi-circumference of cap 72 contain holes 76, 78 that align with threaded holes 80, 82 in rod part 74. Fasteners 84, 86 fasten the cap to the rod part. The cap and rod part have channels 88, 90 that fit to respective portions of a flange 92 of bearing retainer 70. The channel and flange depths are chosen to allow the assembled cap and rod part to move axially a short distance on the bearing retainer, thereby changing the overall length, as marked by the reference 94 in FIG. 4. Mechanism 68 may comprise passive and/or active elements for accomplishing overall length change and corresponding compression ratio change. The channels form the groove, and the flange the tongue, of a tongue-and groove type joint providing for sliding motion that adjusts the length of the connecting rod assembly.

While a presently preferred embodiment has been illustrated and described, it is to be appreciated that the invention may be practiced in various forms within the scope of the following claims.

What is claimed is:

1. A variable length connecting rod assembly for imparting a variable compression ratio to an internal combustion engine, the assembly comprising:

a first part, a second part, and a third part assembled together to form the large end of the connecting rod assembly and provide a variable length for the connecting rod assembly;

the first part comprising a semi-circular cap;

one of the second and third parts being fastened tight to the first part; and guides disposed at opposite sides of the large end operatively relating the other of the second and third parts and the fastened parts to provide for relative sliding motion between the other of the second and third parts and the fastened parts over a limited adjustment range to change the length of the connecting rod assembly;

fasteners disposed on opposite sides of the large end for fastening the one of the second and third parts tight to the first part;

wherein the one of the second and third parts fastened tight to the first part by the fasteners comprises a semi-circular cap fastened to the semi-circular cap of the first part providing for the two fastened semi-circular caps to girdle a crank pin; and the guides comprise surfaces of the fasteners disposed in through-holes in the other of the second and third parts.

2. A variable length connecting rod assembly as set forth in claim 1 in which the other of the second and third parts comprises a connecting rod portion, and the through-holes are disposed at ends of arms of the other of the second and third parts that extend to opposite side of the connecting rod portion at the large end of the connecting rod assembly.

3. A variable length connecting rod assembly as set forth in claim 2 further comprising additional parts assembled to opposite sides of the large end of the connecting rod assembly to aid in providing guidance for relative sliding motion between the other of the second and third parts and the fastened parts.

4. A variable length connecting rod assembly as set forth in claim 3 in which the additional parts comprises channels.

5. A variable length connecting rod assembly as set forth in claim 1 in which the fasteners comprise shoulders spaced from heads, the shoulders abut the one of the second and third parts to fasten the one part tight to the first part, and the heads are disposed to be abutted by the other of the second and third parts to define a limit of maximum length for the connecting rod assembly.

6. A variable length connecting rod assembly for imparting a variable compression ratio to an internal combustion engine, the assembly comprising:

a first part, a second part, and a third part assembled together to form the large end of the connecting rod assembly and provide a variable length for the connecting rod assembly along a longitudinal centerline extending from the large end to a point of attachment to a piston;

the first part comprising a semi-circular cap;

one of the second and third parts being fastened tight to the first part; and guides disposed at opposite sides of the large end lateral to and parallel with the longitudinal centerline for operatively relating the other of the second and third parts and the fastened parts to provide for relative sliding motion between the other of the second and third parts and the fastened parts over a limited adjustment range to change the length of the connecting rod assembly;

fasteners disposed on opposite sides of the large end for fastening the one of the second and third parts tight to the first part;

wherein the one of the second and third parts fastened tight to the first part by the fasteners comprises a connecting rod portion having, at one end, a semi-circular cap fastened to the semi-circular cap of the first part, the two fastened caps capture the other of the second and third parts, and the guides comprise tongue-and-groove type guides;

the tongues are disposed on the other of the second and third parts, and the grooves are disposed on the two fastened semi-circular caps.

* * * * *